US009267446B2

(12) United States Patent
Killion et al.

(10) Patent No.: US 9,267,446 B2
(45) Date of Patent: Feb. 23, 2016

(54) ENGINE SPEED MANAGEMENT CONTROL SYSTEM FOR COLD PLANERS

(75) Inventors: Daniel Killion, Blaine, MN (US); Andrew Krolnik, Brooklyn Park, MN (US); Craig Steffen, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 909 days.

(21) Appl. No.: 13/524,786

(22) Filed: Jun. 15, 2012

(65) Prior Publication Data

US 2013/0333664 A1 Dec. 19, 2013

(51) Int. Cl.
*F02D 41/08* (2006.01)
*F02D 29/00* (2006.01)

(52) U.S. Cl.
CPC ..... *F02D 29/00* (2013.01); *F02D 41/083* (2013.01); *F02D 2250/24* (2013.01)

(58) Field of Classification Search
CPC ..... F02D 41/083; F02D 2250/24
USPC ..... 123/339.16–339.18
See application file for complete search history.

(56) References Cited

U.S. PATENT DOCUMENTS

| | | | | |
|---|---|---|---|---|
| 5,479,908 | A | 1/1996 | Grinberg et al. | |
| 5,527,156 | A | 6/1996 | Song | |
| 5,528,500 | A * | 6/1996 | Al-Charif et al. | 701/99 |
| 5,999,872 | A | 12/1999 | Kinugawa et al. | |
| 6,092,504 | A * | 7/2000 | Barnes et al. | 123/357 |
| 6,233,511 | B1 | 5/2001 | Berger et al. | |
| 7,353,105 | B2 | 4/2008 | Mino et al. | |
| 7,422,391 | B2 | 9/2008 | Holl et al. | |
| 7,702,450 | B2 * | 4/2010 | Pfohl et al. | 701/112 |
| 7,774,117 | B2 | 8/2010 | Ozawa et al. | |
| 7,905,682 | B2 | 3/2011 | Holl et al. | |
| 8,424,630 | B2 * | 4/2013 | Lenton | 180/307 |
| 2003/0079720 | A1 * | 5/2003 | Mccauley et al. | 123/350 |
| 2003/0109977 | A1 * | 6/2003 | Landes et al. | 701/54 |
| 2006/0276304 | A1 * | 12/2006 | Jensen et al. | 477/205 |
| 2007/0150166 | A1 | 6/2007 | Mino et al. | |
| 2008/0173740 | A1 | 7/2008 | Parker et al. | |
| 2009/0320461 | A1 | 12/2009 | Morinaga et al. | |
| 2010/0014917 | A1 | 1/2010 | Willis et al. | |
| 2010/0144489 | A1 | 6/2010 | Sato | |
| 2010/0192907 | A1 | 8/2010 | Stemler et al. | |

FOREIGN PATENT DOCUMENTS

| | | |
|---|---|---|
| JP | 2012057495 | 3/2012 |

OTHER PUBLICATIONS

Caterpillar; "*PM-201 Cold Planer*"; article; 2005; pp. 1-16.

* cited by examiner

*Primary Examiner* — Erick Solis
(74) *Attorney, Agent, or Firm* — Miller, Matthias & Hull LLP

(57) ABSTRACT

An engine speed management control system for machines such as cold planers to regulate the idle engine speed as components of the machine are operated to perform functions while the engine is idling. An auto engine speed control routine may determine a combination of active functions of the components being performed and a corresponding idle engine speed to generate sufficient power and pressurized fluid flow to perform the functions. Upon detecting a change in the combination of active functions, the algorithm may change the idle engine speed as dictated by the new combination, or may wait for a specified delay period to determine whether further changes occur to the combination of active functions.

14 Claims, 6 Drawing Sheets

120

| Engine Speed (rpm) | Non Milling Operation |
|---|---|
| 800 | Initial startup |
| | No functions active or being comanded |
| | |
| 1000 | All lights on |
| | Generator on |
| | Air compressor on |
| | |
| 1300 | Operate legs |
| | Operate sideplate |
| | Operate moldboard |
| | Operate anti-slab |
| | Conveyor on |
| | Conveyor angle |
| | |
| 1600 | Two operations from same pump |
| | |
| 1900 | Two operations from same pump with high flow demand |
| | Three or more operations from same pump |
| | |

FIG. 3

160

| Machine Function | Function State | Engine Power Demand |
|---|---|---|
| Front Legs | Raise or Lower | 3 |
| Rear Legs | Raise or Lower | 4 |
| Right Sideplate | Raise or Lower | 2 |
| Left Sideplate | Raise or Lower | 2 |
| Moldboard | Raise or Lower | 2 |
| Antislab | Raise or Lower | 2 |
| Rotor Service Door | Raise or Lower | 2 |
| 1st Stage Conveyor | On | 3 |
| 2nd Stage Conveyor | On | 3 |
| 2nd Stage Conveyor Fold | Fold or Unfold | 2 |
| 2nd Stage Conveyor Vertical Angle | Raise or Lower | 2 |
| 2nd Stage Conveyor Yaw Angle | Swing Left or Right | 2 |
| Generator | On | 2 |
| Air Compressor | On | 2 |
| Lights | On | 2 |
| Dust Abatement | On | 2 |
| Water Spray System | On | 2 |
| Front Steering | Steer Left or Right | 4 |
| Rear Steering | Steer Left or Right | 4 |
| High Pressure Wash | On | 3 |
| Water Fill Pump | On | 2 |

FIG. 5

162

| Active Functions Total | Idle Engine Speed |
|---|---|
| 0 – 4 | 800 rpm |
| 5 – 6 | 1050 rpm |
| 7 – 8 | 1300 rpm |
| 9+ | 1600 rpm |

FIG. 6

ENGINE SPEED MANAGEMENT CONTROL SYSTEM FOR COLD PLANERS

TECHNICAL FIELD

This disclosure relates generally to cold planers and, in particular, to systems and methods for controlling the idle engine speeds of cold planers and other machines to optimize the performance and fuel efficiency of the machines as various components powered by the engine are operated.

BACKGROUND

Cold planers, also known as pavement profilers, road milling machines or roadway planers, are machines designed for scarifying, removing, mixing or reclaiming material from the surface of bituminous or concrete roadways and similar surfaces. Cold planers typically have a plurality of tracks or wheels which adjustably support and horizontally transport the machine along the surface of the road to be planed. Cold planers also have a rotatable planing rotor or cutter that may be mechanically or hydraulically driven to grind up and scrape off the top surface of the road over which the cold planer is driven. As the rotor grinds up the surface of the road, conveyors at the front of the cold planer transport the loose material and dump it into the bed of a truck driving in front of or to the side of the cold planer.

The tracks or wheels and the rotor of the cold planer are driven by an engine of the machine. The cold planer includes additional components and systems that draw power from the engine when operated to perform various functions of the cold planer. Many components function together to regulate the amount of material removed by the rotor, and to contain the removed material and transport the material to the collection vehicle. For example, vertical adjustment of the cold planer with respect to the road surface may be provided by hydraulically adjustable struts or legs that support the cold planer above its tracks or wheels. The legs are extended and retracted to control the depth to which the rotor grinds into the surface. Sideplates disposed on either side of the rotor are raised and lowered to provide a visual depth reference as the cold planer moves across the surface as well as providing lateral enclosure of the rotor and containment of the removed material. The sideplates are typically part of the grade control system and serve as the grade reference used by the control system. A moldboard behind the rotor is positioned at a depth lower than the bottom surfaces of the sideplates to scrape up the loose material and clean the surface so minimal additional cleanup is necessary after the cold planer makes a pass over the surface of the road. An anti-slab in front of the rotor and proximate the first stage conveyor is positioned just above the top surface of the road to break up the material and prevent the rotor from lifting up large chucks of material that are not readily conveyable. A second stage conveyor transports the material up from the first stage conveyor and dumps it into the truck. The second stage conveyor is moved up and down to change its angle and from side to side to properly position the top of the conveyor based on the height and position of the truck. The legs, sideplates, moldboard, anti-slab and conveyors may be driven by hydraulically, with the hydraulics being operated by a common pump that is powered by the engine. Cold planers usually include additional components drawing power from the engine, such as lights, generators and air compressors.

Many of the components of the cold planer may be operated while the cold planer is idling. For example, the positions of the legs, sideplates, moldboard, anti-slab and second stage conveyor may be adjusted before engaging the rotor and making a pass over a surface. Moreover, the rotor may be engaged or disengaged when the engine is idling and not being propelled. The engine speed required to provide adequate pressurized fluid flow for driving the various components to perform the functions of the cold planer varies based on the component being operated, and the combinations of components that are simultaneously being powered by the engine. The lights, generators and air compressors may require minimal power and low engine speeds to operate. In contrast, operating the legs to raise or lower the cold planer simultaneously with repositioning the second stage conveyor may require a greater amount of power via pressurized fluid flow that is supplied by running the engine at a higher engine speed. The operator does not always know the optimum engine speed necessary for performing the functions, and is typically not able to make constant adjustments to the engine speed. The operator may run the engine at a speed that is too low to meet the needs of the operations or, more likely, may run the engine at a higher speed than is required to meet the need such that fuel is wasted and more sound is generated.

In view of this, a need exists for an engine speed management control system for cold planers that is capable of selecting an optimum engine speed for performing the requested operations based on the operations that are being requested, while allowing the operator the ability to override the engine speed to a higher idle where maximum response and cycle times in performing the operations is required.

SUMMARY OF THE DISCLOSURE

In one aspect of the present disclosure, the invention is directed to a machine having an engine, a rotor configured to operatively engage and disengage from the engine, a plurality of components each operatively connected to the engine to receive power from the engine to perform a corresponding function of the machine, a plurality of control switches each corresponding to one of the functions performed by the plurality of components of the machine and configured to provide a control signal according to an actuation status for the corresponding function, and a controller operatively connected to the engine and the plurality of control switches. The controller may be configured to cause the engine to idle at a current idle engine speed corresponding to a current combination of active functions of the plurality of components based on the actuation statuses of the plurality of control switches when the engine is not engaged to propel the machine, and to determine a new combination of active functions of the plurality of components based on the actuation statuses of the plurality of control switches in response to an occurrence of a triggering event. The controller may further be configured to compare the new combination of active functions to the current combination of active functions, and to set the current idle engine speed equal to a new idle engine speed corresponding to the new combination of active functions of the plurality of components and to cause the engine to idle at the new idle engine speed in response to determining that the new combination of active functions is not equal to the current combination of active functions.

In another aspect of the present disclosure, the invention is directed to a method of controlling an idle engine speed of a machine having an engine, a rotor configured to operatively engage and disengage from the engine, a plurality of components of the machine each operatively connected to the engine to receive power from the engine to perform a corresponding function of the machine, and a plurality of control switches each corresponding to one of the functions performed by the plurality of components of the machine and configured to provide a control signal according to an actuation status for the corresponding function. The method may include causing the engine to idle at a current idle engine speed corresponding to a current combination of active functions of the plurality of components based on the actuation statuses of the plurality of control switches when the engine is not engaged to propel the machine, and determining a new combination of active functions of the plurality of components based on the actuation statuses of the plurality of control switches in response to an occurrence of a triggering event. The method may further include comparing the new combination of active functions to the current combination of active functions, and setting the current idle engine speed equal to a new idle engine speed and causing the engine to idle at the new idle engine speed in response to determining that the new combination of active functions is not equal to the current combination of active functions.

Additional aspects of the invention are defined by the claims of this patent.

BRIEF DESCRIPTION OF THE DRAWINGS

FIG. 3 is an exemplary engine speed table of non-milling operations and corresponding idle engine speeds;

FIG. 5 is an exemplary machine function demand table of engine power demands for non-milling operations;

FIG. 6 is an exemplary engine speed lookup table of active function totals of non-milling operations' engine power demands and corresponding idle engine speeds.

DETAILED DESCRIPTION

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . ." or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
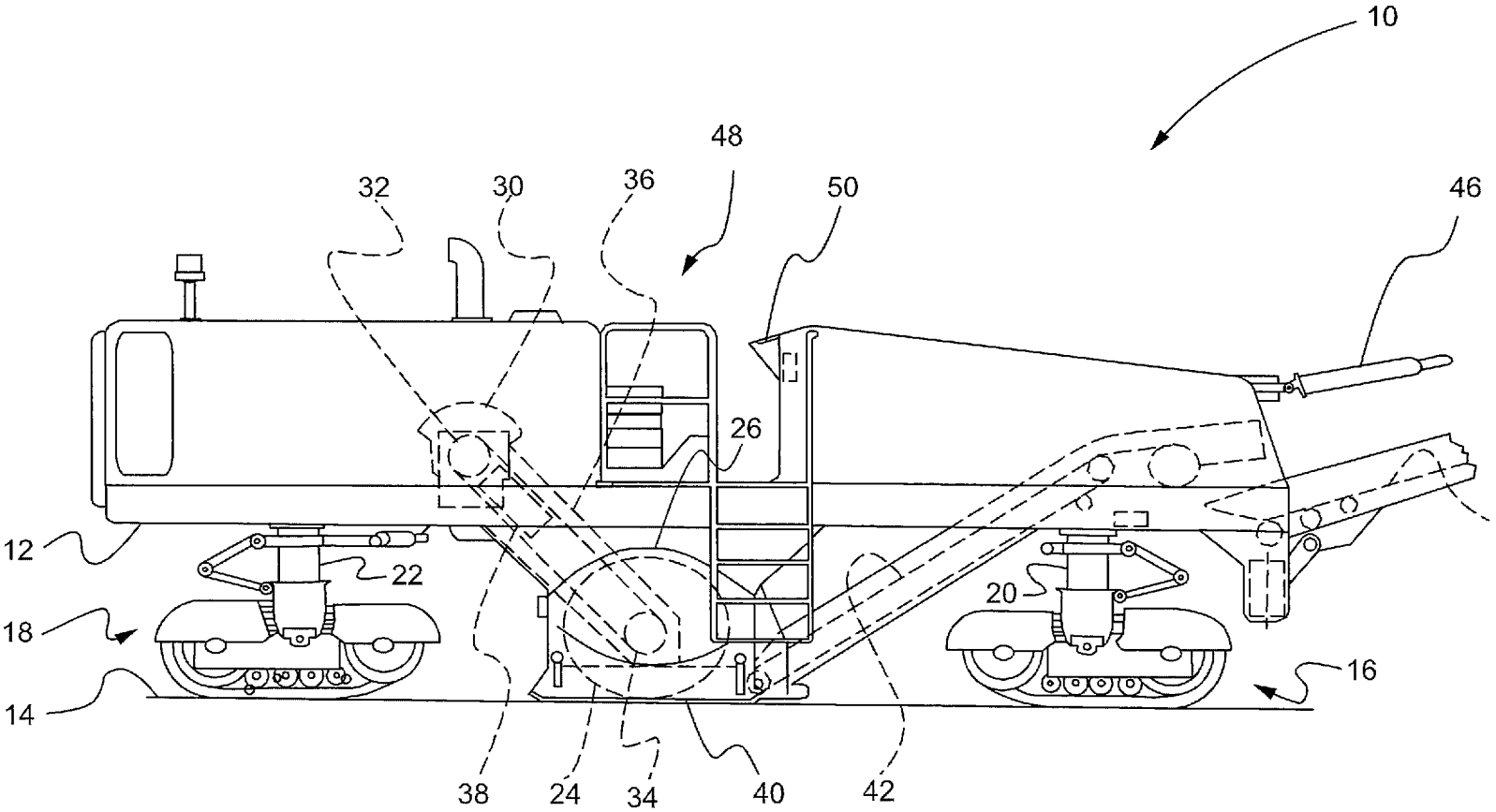
FIG. 1 is a side view of a cold planer having an engine speed management control system in accordance with the present disclosure.

A cold planer 10 is illustrated in FIG. 1 and may include a frame 12 that is carried for movement along a road surface 14 by a pair of front track assemblies 16 and a pair of rear track assemblies 18. The frame 12 is supported on the track assemblies 16, 18 (only two of four track assemblies are shown in the side view of FIG. 1) by hydraulically actuated adjustable struts or legs 20, 22, respectively, that extend between each of the pair of track assemblies 16, 18 and the frame 12. Hydraulic cylinders (not shown) are used to extend and retract the legs 20, 22 to raise and lower the cold planer 10.

A rotor 24 may be rotatably mounted to the frame 12 and may have a housing 26 surrounding all but the body of the rotor 24, which is necessarily exposed to the road surface 14. The depth of the cut or penetration of the cutting teeth (not shown) of the rotor 24 is controlled by appropriate extension or retraction of the adjustable legs 20, 22 and corresponding cylinders. The cold planer 10 also includes an engine 30 as a source of power that may drive the rotor 24 via a mechanical drive arrangement that may include pulleys 32, 34, a belt 36 and a belt tensioner 38. Of course, as will be apparent to those skilled in the art, other arrangements can be employed besides the mechanical arrangement shown in FIG. 1, such as a gear train, hydraulic system or other mechanism for transforming rotation of the engine into rotation of the rotor 24.

The housing 26 may be made up of several components that assist in containing and removing the material of the road surface 14 that is ground up by the rotor 24, with each of the components being vertically positionable to account for the depth to which the rotor 24 will dig into the road surface 14. Sideplates 40 (only one shown in side view of FIG. 1) may be disposed on either side of the rotor 24 and may be raised and lowered to provide a visual depth reference as the cold planer 10 moves across the road surface 14 as well as to provide lateral enclosure of the rotor 24 and containment of the removed material. A moldboard (not shown) may be disposed behind the rotor 24 and positioned at a depth lower than the bottom surfaces of the sideplates 40 to scrape up loose material and clean the road surface 14 so minimal additional cleanup is necessary after the cold planer 10 makes a pass over the road surface 14. An anti-slab (not shown) disposed in front of the rotor 24 may be positioned just above the top of the road surface 14 to break up the material and prevent the rotor 24 from lifting up large chucks of material that are not readily conveyable. The cold planer 10 may also include a first stage or pickup conveyor 42 which delivers debris to a second stage or discharge conveyor 44. The discharge conveyor 44 and its associated framing and pulleys (not shown) may be supported by a telescoping arm 46, both of which are only partially shown in FIG. 1. Finally, the cold planer 10 may also includes an operator area 48 having a control console 50 with the necessary instruments to allow an operator to control the operation of the various components of the cold planer 10.

Figure 2:
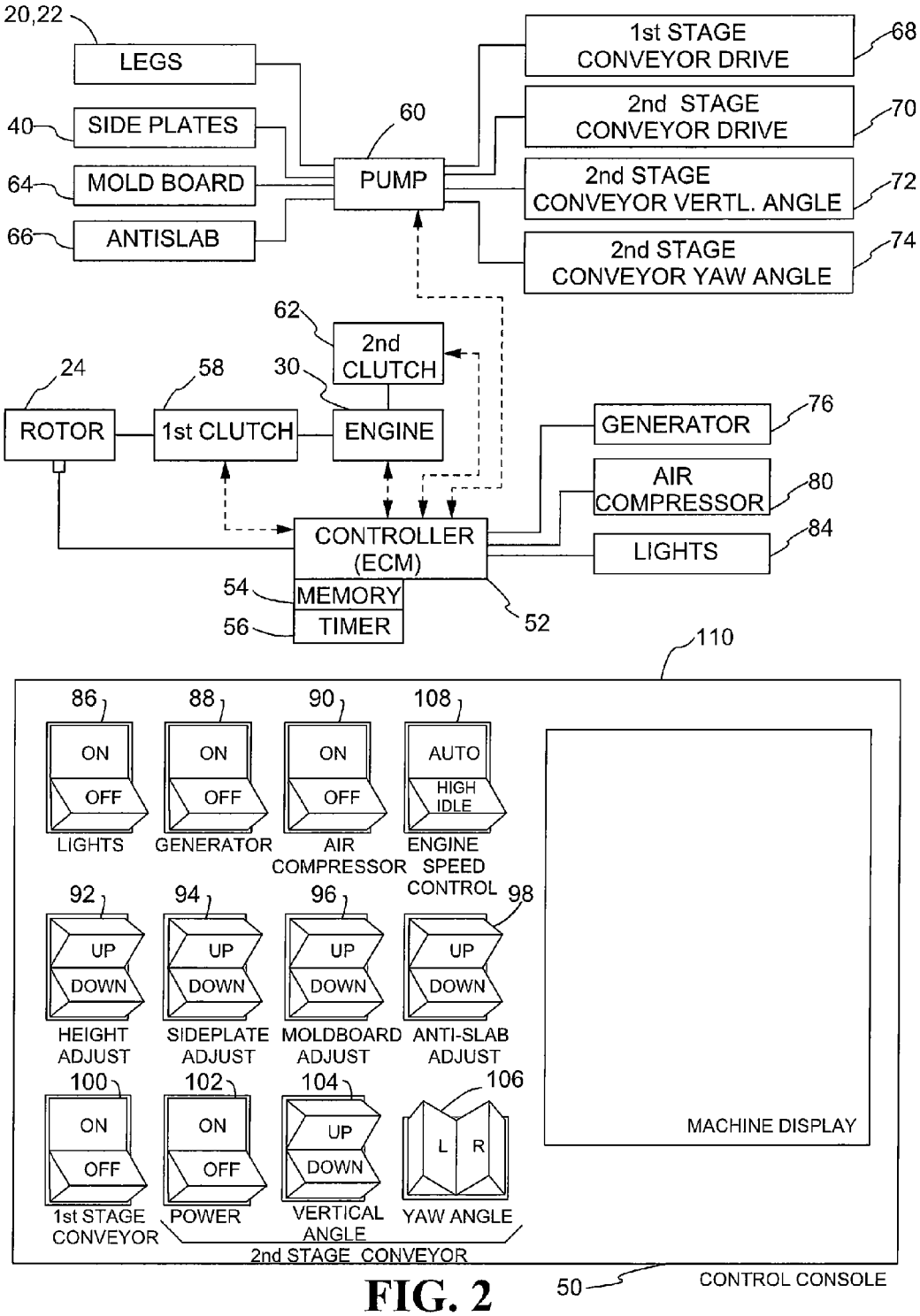
FIG. 2 is a schematic illustration of the communication between the controller, the control console and various controlled components of the cold planer of FIG. 1.

A control console 50 is partially illustrated in FIG. 2 which schematically illustrates the relationship between a controller or ECM 52 of the cold planer 10 and the remaining components relevant to the systems and methods described in the present disclosure. Of course, the control console 50 may also include gauges for water pumps, compressors and other components, status indicators, additional switches and the like, that are omitted from the illustration and discussion for the sake of clarity on the disclosure. As illustrated in FIG. 2, the controller 52 may include a memory 54, and may also include a clock or timer 56. The controller 52 may be linked to the engine 30, and to a first clutch 58 that may be a hydraulically actuated clutch 58 that is coupled to the engine 30. The first clutch 58 may also be detachably engaged to the rotor 24, which may also be linked to the controller 52.

The cold planer 10 may further include at least one pump 60 that may be linked to the controller 52 for providing pressurized fluid flow to the hydraulic elements that cause the movements of various components of the cold planer 10. The pump 60 may be coupled to the engine 30 by a second clutch 62 that may also be linked to the controller 52. The controller 52 may be capable of actuating and de-actuating the second clutch 62 to alternately couple and decouple the engine 30 and the pump 60. In the illustrated embodiment, the pump 60 may be coupled to multiple components of the cold planer 10 and provide hydraulic fluid to the various hydraulic elements as commanded by the controller 52. For example, the pump 60 may provide pressurize fluid flow to the hydraulic elements of the legs 20, 22, the sideplates 40, the moldboard 64, the anti-slab 66, the pickup and discharge conveyor drives 68, 70, respectively, and the discharge conveyor vertical and yaw angle controllers 72, 74, respectively. Control signals from the controller 52 may cause the pump 60 to direct fluid flow to the appropriate hydraulic elements as commanded by the operator.

The engine 30 may provide power to additional elements of the cold planer 10 that may be turned on and off based on the operator's needs. For example, a generator 76, an air compressor 80 and lights 84 may be linked to the controller 52 and electrical system of the cold planer 10 that is powered by the engine 30 when running. Those skilled in the art will understand that additional components controlled by the operator of the cold planer 10 and drawing power from the engine may be present in the cold planer 10.

Still referring to FIG. 2, the control console 50 may include a variety of operator inputs to control the operation of the various components of the cold planer 10. ON/OFF switches 86, 88, 90 for the lights 84, generator 76 and air compressor 80, respectively, may cause the controller 52 to turn the components on and off as necessary. In the cases of the generator 76 and air compressor 80, setting the switches 88, 90 to the "ON" positions may cause the controller 52 to actuate the generator 76 and air compressor 80 and thereby draw power from the engine 30. Vertical adjustment switches 92, 94, 96, 98 may toggle between "UP" and "DOWN" positions to control height adjustment for the legs 20, 22, sideplates 40, moldboard 64 and anti-slab 66, respectively. When one of the vertical adjustment switches 92, 94, 96, 98 is actuated in either setting, the controller 52 may cause the second clutch 62 to engage the engine 30 to transmit power to the pump 60 if the second clutch 62 is not already engaged, and cause the pump 60 to provide pressurized fluid flow to hydraulic elements of the components 20, 22, 40, 64, 66 corresponding to the actuated switches 92, 94, 96, 98 to raise or lower the components.

ON/OFF switches 100, 102 may also be provided for the pickup and discharge conveyor drives 68, 70, respectively. Setting the switches 100, 102 to the "ON" positions may cause the controller 52 to signal the second clutch 62 to engage the engine 30 if the second clutch 62 is not already engaged to transmit power to the pump 60, and cause the pump 60 to provide pressurized fluid flow to the conveyor drives 68, 70. If the speeds of the conveyors 42, 44 are controllable by the operator, the ON/OFF switches 100, 102 may be replaced or supplemented on the control console 50 by dials, potentiometers or other control mechanism capable of providing a variable signal to the controller 52 indicative of speeds at which the conveyors 42, 44 are to operate, and the controller 52 may be programmed to transmit corresponding signals to the pump 60 to control the fluid flow transmitted to the conveyor drives 68, 70. Additional switches 104, 106 may be provide for adjustment of the vertical angle and yaw angle, respectively, of the discharge conveyor 44 by sending signals to the controller 52 to cause the pump 60 and second clutch 62 to provide fluid flow to the vertical angle controller 72 and yaw angle controller 74 for moving the discharge conveyor 44 to a desired position.

Controls for additional functionality of the cold planer 10 may also be provided at the control console 50. An engine speed control switch 108 may be provided to allow the operator to select between engine speed control modes that are available for operation of the cold planer 10. The operator may be provided with the ability to cycle between an auto engine speed control mode discussed in further detail below, and a high idle engine speed mode. The engine speed control switch 108 may allow the operator to cycle between the modes. Setting the engine speed control switch 108 in the "AUTO" mode position may cause the controller 52 to control the speed of the engine 30 according to the strategy detailed hereinafter, while the "HIGH IDLE" setting may cause the controller 52 to cause the engine 30 to idle at a predetermined speed that may be greater than an engine speed that may be determined by the auto engine speed control.

The controller 52 of the cold planer 10 may also be programmed with a service mode that also allows the operator to override the auto engine speed control routine to operate the engine 30 at a desired engine speed. The service mode may be available to the operator for instances where the operator wants the engine 30 to run at a specific engine speed. The service mode may provide the operator with the ability to manually adjust the engine speed to a desired setting for troubleshooting problems with the cold planer 10. The service mode may be available through a machine display 110 on the control console 50. The operator may navigate into the service mode screen via the machine display 110 if provided as a touch screen, via the engine speed control switch 108 if provided as an additional control option, or through additional controls that may be provided on the control console 50.

Once in the service mode, the operator may select a desired engine speed from a range of engine speeds that may be selectable on the machine display 110. For example, the engine speed may be selectable from a range having a minimum speed of 800 RPM, a maximum speed of 1,900 RPM, and discrete intervals of 50 RPM there between. When in the service mode, certain functions of the cold planer 10 may be partially locked out by the controller 52. The operator may not be able to engage the rotor 24 or propel the cold planer 10 forward or backward. Also, the cold planer 10 may be configured to prevent the operator from entering the service mode if any of the functions that are locked out when the cold planer 10 is in the service mode are currently active. Once the operator has completed troubleshooting the cold planer 10, the operator may exit the service mode through the machine display 110 or other mode control switches.

When the cold planer 10 is running but idling, and the various components drawing power from the engine 30 are actuated by the operator, the engine speed must increase to meet the power and pressurized fluid flow needs of the components. The operator may not know the engine speed necessary to satisfy the power needs of the components, and may instinctively increase the engine speed, but may run the engine 30 at a higher speed than that required to power the components. Running the engine 30 at a higher speed than necessary wastes fuel and unnecessarily increases the sound produced by the cold planar 10. The difficulty of operation of the cold planer 10 is increased for the operator who attempts to run the engine 30 closer to the minimum required speed to power the components. In order to minimize fuel consumption by the cold planer 10, reduce average sound levels and enhance ease of operation of the cold planer 10 for the operator, the speed of the engine 30 when idling may be automatically adjusted by the controller 52 based on the machine commands that are transmitted from the control console 50 to the controller 52 for the operation of the various components of the cold planer 10.

In one implementation of the cold planer 10, the controller 52 may be provide with a look-up table stored in memory or programmed into the control application program that may specify a speed at which to operate the engine 30 based on the operation or combination of operations being commanded by the operate when the cold planer 10 is idling. FIG. 3 illustrates an example of a table 120 containing information regarding the engine speeds at which the controller 52 may cause the engine 30 to idle when certain operations are commanded at the control console 50. As illustrated in the table 120, the various operations and components of the cold planer 10 may require varying levels of power from the engine 30 to operate. To accommodate the power needs, the engine 30 may be caused to idle at engine speeds corresponding to the power needs of the commanded operations. For example, during initial start-up or where no operations are being commanded by the operator, the controller 52 may cause the engine to idle at a relatively low engine speed, such as 800 RPM.

When the various components are commanded to operate by the operator at the control console 50, the controller 52 may respond by causing the engine 30 to operate at the engine speed specified in the table 120. Different components draw different amounts of power from the engine 30 and, consequently, different engine speeds are required to meet the power needs. Components such as the lights 84, generator 76 and air compressor 80 may require a relatively small amount of additional power to operate. Consequently, when one of the switches 86, 88, 90 is set to the "ON" position, the controller 52 may respond by increasing the engine speed to 1000 RPM. The components having hydraulic elements driven by the pump 60 may require a greater amount of power from the engine 30 and fluid flow from the pump 60 during their operation. As a result, the controller 52 may engage the second clutch 62 to drive the pump 60 and increase the engine speed to 1300 RPM for the pump to drive the hydraulic elements of the commended component.

During the course of operating the cold planer 10, multiple operations may be commanded at the same time. The table 120 may be configured to cause the engine 30 to run at an engine speed that will meet the power requirements for the various commanded operations. Some combinations of operations may only require the engine 30 to operate at the engine speed required for the operation requiring the most power. In such cases, the engine speed may be set to the highest value in the table 120 corresponding to one of the commanded operations. For example, where the operator sets the switches 90, 100 to the "ON" positions to actuation the air compressor 80 and pickup conveyor drive 68, respectively, the controller 52 may cause the engine 30 to operate at 1,300 RPM, which may provide sufficient power for both operations.

Other combinations of operations may require the engine 30 to be operated at a greater speed than is required for either of the individual operations. For example, where multiple components or systems receiving pressurized fluid from a common pump are commanded at the same time, the engine speed may be further elevated to ensure adequate system performance and sufficient fluid provided to the hydraulic elements of the components. The specific amount of engine speed elevation will depend on the combination of functions being commanded. Per the exemplary table 120, where two operations driven off the same pump are commanded, the controller 52 may cause the engine 30 to operate at 1,600 RPM. This may be the case where, for example, the operator uses the switches 94, 96 to adjust the positions of the sideplates 40 and moldboard 64, respectively, up or down. Operations having higher flow demands from the pump 60 may correspondingly require a greater engine speed. As discussed above, the conveyor drives 68, 70 may have variable speeds of operation, and the higher speeds may require greater flow from the pump 60. The required flow may be provided by the controller 52 causing the engine 30 to further increase the engine speed to 1,900 RPM. Greater flow may also be necessary when more than two operations running of the same pump are commanded, and the table 120 may be configured to provide the necessary engine speed to meet the power and fluid flow demands. Those skilled in the art will understand that the engine speed ranges set forth in the table 120 are exemplary only, and the engine speed requirements for particular cold planers 10 and their components and operations will vary based their designs. Such variations are contemplated by the inventors as having use in cold planers 10 in accordance with the present disclosure.

Figure 4:
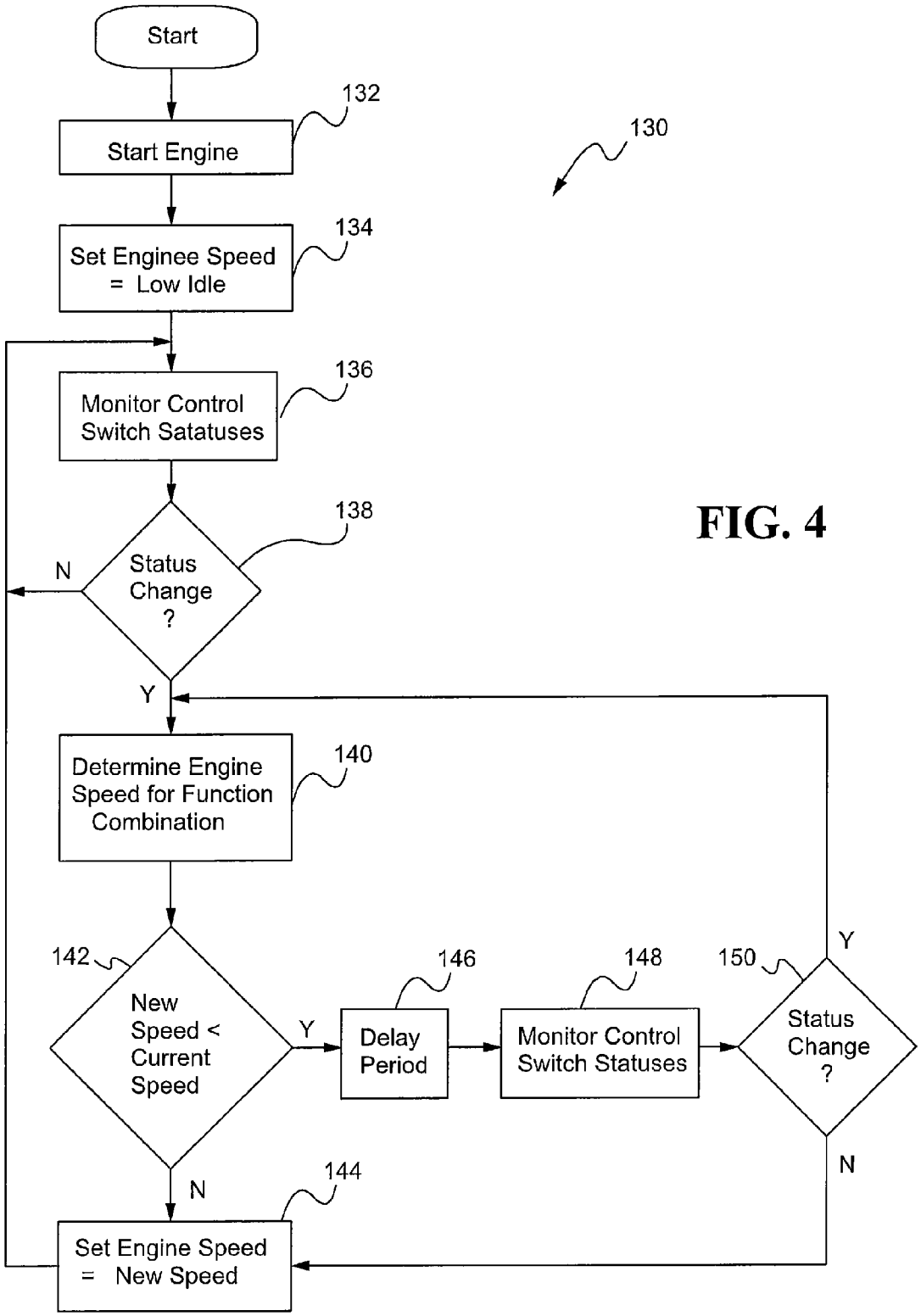
FIG. 4 is a flow diagram illustrating an embodiment of an auto engine speed control routine in accordance with the present disclosure that may be implemented in the cold planer of FIG. 1.

FIG. 4 illustrates an exemplary auto engine speed control routine 130 for controlling the idling speed of the engine 30 of the cold planer 10 or other type of machines or equipment that may perform operations drawing power from the engine 30 while the engine 30 is idling. The execution of the engine speed control routine 130 presumes that the engine speed control switch 108 is set to the "AUTO" position for automatically controlling the engine idling speed, and that the operator has not navigated into the service mode to control the engine speed via the machine display 110. The engine speed control routine 130 may be begin at block 132 wherein the engine 30 may be started up by an operator. When the engine 30 is started, control may pass to a block 134 where the controller 52 may set the engine speed to a low idle speed at which the engine 30 may initially operate, and may subsequently operate when idling with no functions being active or commanded. The low idle speed may be provided by the data of the table 120 as stored in the memory 54 or programmed into the control software implementing the table 120. Once the engine speed is set, the engine 30 will operate at the low idle speed, such as 800 RPM as specified in the exemplary table 120, until a function is commanded by the operator, the rotor 24 or drive mechanism for the cold planer 10 is engaged, or the engine 30 is shut off.

As the engine 30 of the cold planer 10 continues to idle, control may pass to a block 136 wherein the controller 52 monitors the switches 86-106 for actuation by the operator to command a function of the cold planer 10. The controller 52 may check for actuation of the switches 86-106 by an operator at a sampling rate provided by the clock 56. After each monitoring period, control may pass to a block 138 wherein the controller 52 may determine whether a status of any of the switches 86-106 has changed since the previous monitoring period. If the statuses of the switches 86-106 are unchanged, control may pass back to the block 136 for further monitoring for actuation of the switches 86-106.

If the controller 52 determines that the status one or more of the switches 86-106 has changed (e.g., changed from "OFF" to "ON" or "ON" to "OFF," or toggled to "UP" or "DOWN," "LEFT" or "RIGHT," or back to the neutral position) at the block 138, control may pass to a block 140 wherein the controller 52 may determine the engine speed corresponding to the combination of commanded functions indicated by the statuses of the switches 86-106. At block 138, the controller 52 may refer to the engine speed table 120 to determine the appropriate engine speed to provide sufficient power for the functions commanded by the operator via the switches 86-106. As discussed above, the controller 52 may be programmed with the necessary logic for converting the input provided by the switches 86-106 into the engine speeds listed in the table 120. Such logic may include a simple table lookup in a database stored at the memory 54, hard coded logic wherein each combination of actuated switches 86-106 outputs a predetermined engine speed, or combination thereof or other programming methods performing the necessary conversion of inputs into output speeds.

After the controller 52 determines the new engine speed at the block 140, control may pass to block 142 where the controller 52 compares the new engine speed to the current engine speed to determine whether the engine speed is decreasing from the current engine speed setting. If the new engine speed is greater than or equal to the current engine speed, the engine speed change may be executed without delay. Control may pass to a block 144 wherein the controller 52 may set the engine speed to the new engine speed determined based on the engine speed table 120. Once the engine speed is set and the engine speed increases, control may pass back to the block 136 where the controller 52 may continue to monitor the statuses of the switches 86-106 on the control console 50. At the same time, the controller 52 will cause the commanded functions to be performed.

If the new engine speed is determined to be less than the current engine speed at block 142, and the engine will be slowed, it may be desirable to delay slowing the engine to prevent a sudden slowing of the engine followed by an immediate speeding of the engine that may cause additional stress on the engine 30 and fuel usage. Instead, it may be preferable to wait for a specified period of time before slowing the engine 30 to determine whether any additional function commands are input at the control console 50. As a result, where the new engine speed is less than the current engine speed at block 142, control may pass to a block 146 wherein the controller 52 may utilize the clock 56 to delay for a predetermined delay period, such as, for example, three seconds, within which the operator may command additional functions or discontinue functions. It should be noted that the delay period may not cause a corresponding delay in the execution of the requested machine functions.

After the delay period elapses, control may pass to a block 148 wherein the controller 52 monitors the statuses of the switches 86-106 to determine the combination of functions commanded by the operator in a similar manner as the monitoring performed at block 136. After determining the statuses of the switches 86-106 and the corresponding combination of requested functions at block 148, control may pass to a block 150 wherein the controller 52 may determine whether the combination of commanded functions has changed again. If the combination of commanded functions is unchanged, control may pass to the block 144 for the controller 52 to set the engine speed to the new engine speed determined at block 140 so that the engine speed is reduced to the lowest engine speed necessary to support the commanded functions as determined from the engine speed table 120. Once the engine speed is set and the engine speed decreases, control may pass back to the block 136 for continued monitoring of the statuses of the switches 86-106 on the control console 50 by the controller 52. If the combination of commanded functions is determined at block 150 to have changed during the delay period, control may pass to the block 140 for the controller 52 to determine the appropriate engine speed for the new combination of commanded functions.

In an alternative implementation of the cold planer 10, the machine functions performed by the various components of the cold planer 10 may be assigned values based on the hydraulic flow demand placed on the engine 30 when the components are operated to perform the machine functions. The engine power demand values for the active machine functions may be totaled and used by the controller 52 to determine the idle speed of the engine 30 needed to provide sufficient power for performing the active machine functions. FIG. 5 illustrates an example of a machine function demand table 160 containing information regarding the machine functions that may be performed by the components of the cold planer 10, the active function states of the components, and an engine power demand value for each machine function. For example, the front legs 22 may have function states of raising and lowering the cold planer 10 as commanded by the actuation statuses of the switch 92, and those function states may require an engine power demand having a value of "3." The rear legs 20 may have similar function states and be independently controlled by a separate control switch (not shown), but may require a greater engine power demand having a value of "4." The other machine functions discussed above as well as additional machine functions may each be similarly assigned engine power demand values, and those skilled in the art will understand that additional control switches or other actuation means for activating the machine functions may be provide in the operator area 48 as necessary.

The controller 52 may continually monitor the operational statuses of the various machine functions, such as by evaluating the actuation statuses of the control switches 86-106. As the combination of active functions of the components changes, the controller 52 may calculate an active functions total of the engine power demand values from table 160 for the active machine functions to determine the total engine power demand at a point in time. The total engine power demand as indicated by the active functions total may dictate the required idle engine speed for the active machine functions to be performed. FIG. 6 illustrates an alternative configuration of an engine speed lookup table 162 that may be stored by the controller 52. The illustrated table 162 summarizes the idle engine speeds corresponding to the various active functions totals. As the combination of active machine functions changes and, correspondingly, the active functions total changes, the idle engine speed may increase and decrease over time, and the controller 52 may adjust the speed of the engine 30 accordingly.

Figure 7:
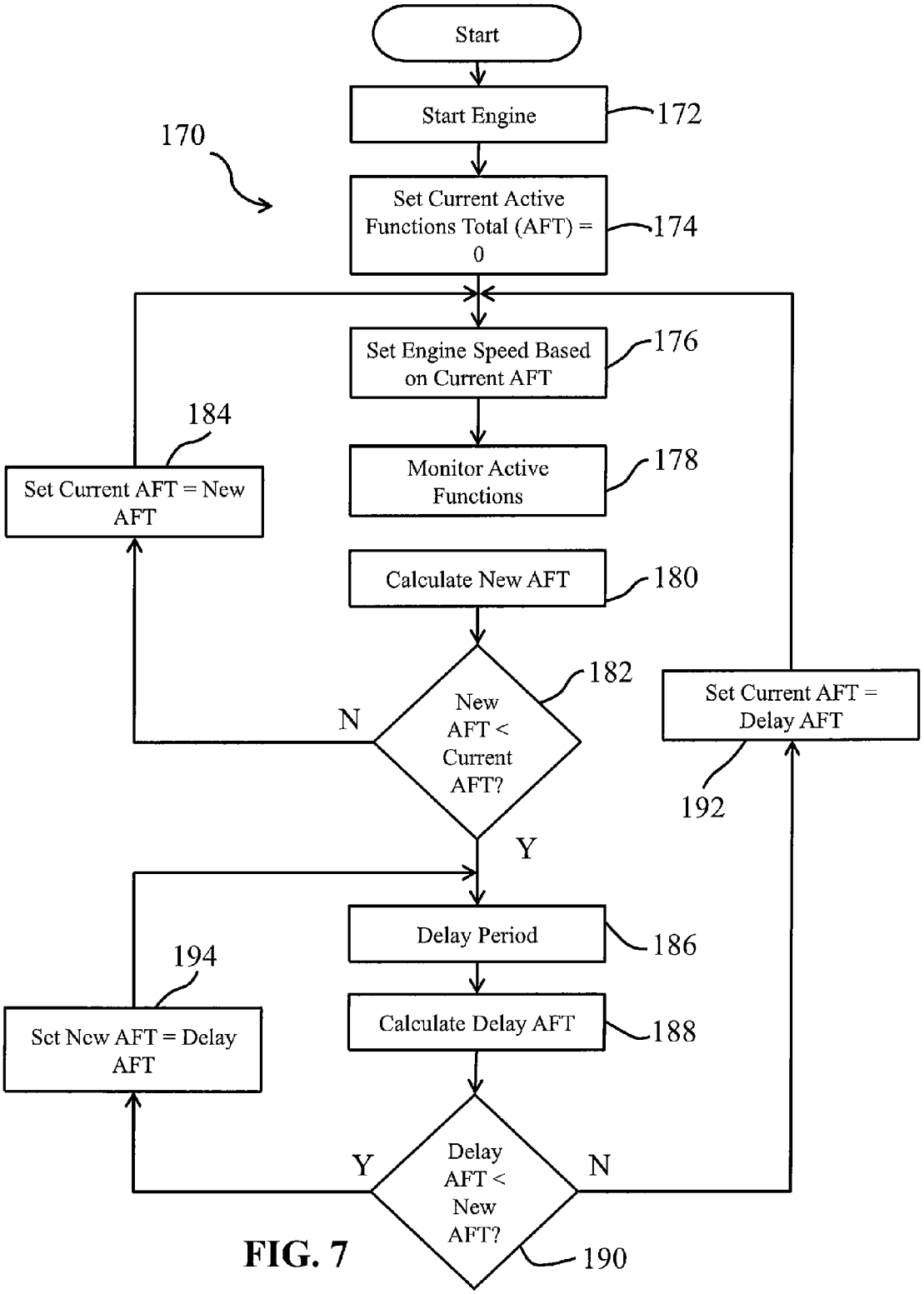
FIG. 7 is a flow diagram illustrating an alternative embodiment of an auto engine speed control routine in accordance with the present disclosure that may be implemented in the cold planer of FIG. 1.

FIG. 7 illustrates an exemplary auto engine speed control routine 170 for controlling the idle engine speed of the engine 30 of the cold planer 10 or other type of machines or equipment using the information in the machine function demand table 160 and the engine speed lookup table 162 when the control switch 108 is set to the "AUTO" position. The engine speed control routine 170 may be begin at block 172 wherein the engine 30 may be started up by an operator. When the engine 30 is started, control may pass to a block 174 where the controller 52 may set a current active functions total equal to zero so the engine 30 may initially idle at a low idle engine speed before the operator starts activating machine functions. Consequently, at a block 176, the controller 52 may set the engine 30 to idle at an idle engine speed based on the value of the current active functions total.

As the engine 30 of the cold planer 10 continues to idle, control may pass to a block 178 wherein the controller 52 monitors the switches 86-106 for actuation by the operator to command a function of the cold planer 10. The controller 52 may check for actuation of the switches 86-106 by an operator at a sampling rate provided by the clock 56, or may continuously monitor the activation statuses of the switches 86-106 and detect a change in activation status of one or more of the switches 86-106. On the occurrence of a triggering event such as the elapsing of the sampling period or detection of an activation status change, control may pass to a block 180 wherein the controller 52 may calculate a new active functions total by summing the engine power demand values from the table 160 for the new combination of active machine functions.

The new active functions total may or may not require a change in the idle engine speed. As with the routine 130, the routine 170 may allow the idle engine speed to increase immediately if necessary when there is a new combination of active functions, but wait for a prescribed delay period when the engine power demand decreases to determine whether other machine functions are activated and would necessitate and idle engine speed increase. After calculating the new active functions total, control may pass to a block 182 to compare the new active functions total to the current active functions total. If the new active functions total is not less than the current active functions total, the idle engine speed may remain the same or increase. In this situation, control may pass to a block 184 to set the current active functions total equal to the new active functions total, and then to the block 176 to set the idle engine speed based on the new value of the current active functions total.

If the new active functions total is less than the current active functions total at the block 182, it may ultimately be necessary to decrease the idle engine speed if no other changes are made to the combination of active functions. In this situation, control may pass from the block 182 to the block 186 wherein the controller 52 may utilize the clock 56 to delay for a predetermined delay period, such as, for example, three seconds, within which the operator may activate additional functions or discontinue functions. It should be noted that the delay period may not cause a corresponding delay in the execution of the requested machine functions.

After the delay period elapses, control may pass to a block 188 may calculate a delay active functions total by summing the engine power demand values from the table 160 for the combination of active machine functions at the end of the delay period. After calculating the delay active functions total, control may pass to a block 190 wherein the controller 52 may determine whether the delay active functions total is less than the new active functions total that was calculated before the delay period. If the delay active functions total is not less than the new active functions total, the post-delay combination of active functions has the same engine power demand and requires the same idle engine speed, or an increase in the engine power demand and corresponding increase in the idle engine speed. In this situation, control may pass to a block 192 to set the current active functions total equal to the delay active functions total, and then to the block 176 to set the idle engine speed based on the new value of the current active functions total.

If the current active functions total is less than the new active functions total at the block 190, it may be desired to wait for additional changes to the combination of active functions before decreasing the idle engine speed. Consequently, control may pass from the block 190 to a block 194 wherein the controller 52 may set the new active functions total equal to the delay active functions total, and then to the block 186 to initiate a second delay period and to the block 188 to calculate a second delay active functions total for the combination of active functions after the second delay period. The second delay active functions total is then compared to the new active functions total at the block 190 to determine whether to reset the idle engine speed or to continue waiting for additional delay periods until the combination of active functions and corresponding active functions total stop decreasing.

The engine speed control routines 130, 170 as described above may be executed by the controller 52 during periods when the cold planer 10 is running but is not being propelled forward. In other operational states of the cold planer 10, the blocks of the engine speed control routines 130, 170 may be modified or overridden in their entirety based on the engine speed control requirements for the cold planer 10. In the service mode as described above, the operator via the machine display 110 may operate the engine 30 at a specified speed for troubleshooting problems with the cold planer 10. As another example, when the cold planer 10 is in a static or non-propelled state with the rotor 24 engaged, the auto engine speed control routines 130, 170 may be active but modified to reflect the minimum engine speed requirements for the engaged rotor 24. The engine speeds specified in the tables 120, 162 may be overridden to the extent they are lower than the minimum speed for the engaged rotor 24. The minimum idle engine speed for the engaged rotor 24 may be, for example, 1,150 RPM, and the controller 52 may only modify the engine speed if the engine speed required for the commanded combination of active functions per tables 120, 170 is greater than what is necessary for the rotor 24. Where no operations are commanded, or only a combination with a relative low engine power demand for idling are commanded, the controller 52 may set the engine speed to 1,150 RPM at blocks 134, 144, or 176. If operation of a sufficiently high engine power demand combination of active functions is commanded, the controller 52 may set the engine speed to an appropriate idle engine speed above 1,150 RPM. When sufficient active functions are turned off by the operator to reduce the engine power demand, the controller 52 reduces the engine speed back down to the low idle speed of 1,150 RPM for the rotor 24 after the specified delay period.

When the rotor is engaged and the engine 30 is engaged to propel the cold planer 10 forward, the auto engine speed control routines 130, 170 may be disabled. The engine speed may remain at the milling rotor speed requested by the operator at controls provided in the operator area 48, such as 1,600, 1,750 or 1,900 RPM. When the cold planer 10 is stopped and the engine 30 is disengaged from the rotor, the engine speed control routines 130, 170 may be re-enabled for the controller 52 to resume control of the idle engine speed of the engine 30.

The operator or a technician may have the capability to override the auto engine speed control routines 130, 170 to dictate engine speeds necessary for performing certain operations or testing of the cold planer 10. The operator or technician may have the ability to cycle between the auto engine speed control routines 130, 170 and a forcing a high idle engine speed, such as 1,900 RPM. The operator may cycle between the control mode and high idle mode via the engine speed control switch 108 at the control console 50. Toggling the engine speed control switch 108 to the "HIGH IDLE"

position may cause the controller 52 to operate the engine 30 at the predetermined high idle engine speed. Toggling the engine speed control switch 108 back to the "AUTO" position may re-enable execution of the engine speed control routines 130, 170 by the controller 52. When the rotor 24 is engaged, the ability to cycle between the manual and auto engine speed control modes may be disabled, and the engine speed may be dictated by either the desired rotor milling speed set by the operator as discussed above, or by the engine speed control routines 130, 170 if a specific engine speed is not commanded by the operator.

INDUSTRIAL APPLICABILITY

In operation, the auto engine speed control routines 130, 170 control the idle speed of the engine 30 of the cold planer 10. At the beginning of a planing job, an operator may start the engine 30 of the cold planer 10. Using the routine 130 in the following example, if the engine speed control switch 108 is sent to "AUTO," the controller 52 may set the engine 30 to idle at 800 RPM per the engine speed table 120 at block 134. If the job is being started first thing in the morning, the operator may set the light switch 86 to the "ON" position to turn on the lights 84. The controller 52 may detect the change in status of the light switch 86 at block 138, and determined that the engine speed should be increased to 1000 RPM 140. Because the engine speed is increasing, the controller 52 may set the engine 30 to the new engine speed at block 144 without waiting for a delay period.

Once the cold planer 10 is started and idling, the operator may position the rotor 24 and housing 26 in preparation for making the initial pass over the road surface 14. The operator may set the height of the rotor 24 via the legs 20, 22. Assuming the rotor 24 is elevated above the road surface 14, the operator may press the height adjustment switch 92 to the "DOWN" position to lower the rotor 24 into position. The controller 52 may detect the actuation of the height adjustment switch 92 at block 136, and transmit control signals to the clutch is 62 to engage and to the pump 60 to control the flow of hydraulic fluid to the actuators for the legs 20, 22 to lower the cold planer 10. The controller also determines that the combination of the lights 84 and the movement of the legs 20, 22 dictates an engine speed of 1,300 RPM at block 140 and since the engine speed to the elevated idle speed at block 144.

When the rotor 24 is in position, the operator may release the height adjustment switch 92 allow the switch 92 to move to its neutral position. The status change of the switch 92 may be detected by the controller 52 at the block 138, and the controller 52 missing control signals to the pump 60 to discontinue actuation of the legs 20, 22. The controller 52 may determine that the engine speed is to be reduced to 1,000 RPM at block 140. The engine speed reduction causes the controller 52 to transfer control from the block 142 to the block 146 for the clock 56 to countdown the predetermined delay period, such as 3 seconds, to determine whether other functions are commanded by the operator. During the delay period, the engine speed is maintained at 1,300 RPM.

With the rotor 24 in position, the operator may actuate the sideplate adjustment switch 94 and the moldboard adjustment switch 96 to begin the adjustment of the housing 26 by positioning the sideplates 40 and the moldboard 64. The controller 52 may detect the actuation of the switches and 94, 96 at block 148, 150, and transfer control back to the block 140 to determine the new engine speed. At the same time, the controller 52 may send control signals to the pump 60 to supply hydraulic fluid to the actuators for the sideplates 40 and moldboard 64. The controller 52 may determine at the block 140 that the idle engine speed should be 1,600 RPM for performing two operations on the same pump 60, and may set the engine 30 to idle at the new engine speed at block 144.

After the sideplates 40 and the moldboard 64 are in position, the operator may release the switches 94, 96 to allow them to return to their positions, and actuate the height adjustment switch 98 to position the anti-slab 66. The controller 52 may detect the change in status of the switches 94, 96, 98 at the block 136 and determined that the appropriate engine speed for operating the anti-slab 66 as 1,300 RPM at the block 140. The controller 52 may command the pump 60 to cease flow of hydraulic fluid to the actuators for the sideplates 40 and the moldboard 64, and to begin pumping hydraulic fluid to the actuator for the anti-slab 66, but may delay decreasing the engine speed during the delay period of the block 146. After the delay period elapses with the height adjustment switch 98 still actuated, the controller 52 may set the new engine speed at the block 144 to slow the engine 30 to the specified stream. When the anti-slab 66 is in position, the operator may release the height adjustment switch 98. The controller 52 may detect the status change of the height adjustment switch 98 at the block 136 and determined that the engine speed should be decreased to 1,000 RPM at the block 140 because the lights 84 are still turned on. The controller 52 may send control signals to the pump 60 to cease the flow of hydraulic fluid to the actuator for the anti-slab 66 and, after waiting for the delay period to elapse at block 146 and not detecting further changes in the status is of the switches 86-106, reduce the engine speed to 1,000 RPM at block 144.

With the rotor 24 and the housing 26 positioned, the operator may use the appropriate controls in the operator area 48 to engage the rotor 24. The controller 52 may detect the engagement of the rotor 24 and may set the low idle speed for the engine 30 to the engine speed specified for rotor engagement, such as 1,150 RPM. Prior to propelling the cold planer 10 forward, the operator may turn on the conveyors 42, 44 by setting the switches 100, 102 to their "ON" positions. The controller 52 may detect the actuation of the switches 100, 102 at the block 136. The conveyors 42, 44 may have a high flow demand from the pump 60, and consequently the controller 52 may determine at the block 140 that the idle engine speed should be set to 1,900 RPM, and may set the engine 30 to idle at that speed at the block 144. At this point, the operator may engage the transmission of the cold planer 10 to propel the cold planer 10 forward for its initial pass over road surface 14. Engagement of the transmission may cause the controller 52 to disable the auto engine speed control routine 130.

At the end of the job, after the final pass of the cold planer 10 over the road surface 14, the operator may disengage the transmission to stop the cold planer 10. The controller 52 may detect the disengagement of the transmission and re-enable the auto engine speed control routine 130 to control the idle speed of the engine 30. With the rotor 24 remaining engaged and the conveyors 42, 44 running, the controller 52 may determine that the appropriate engine speed is 1,900 RPM based on the engine speed table 120 at the block 140, and set the engine speed to the new idle speed at the block 144. After the cold planer 10 stops, the operator may disengage the rotor 24 and turn off the conveyors 42, 44 by setting the switches 100, 102 to their "OFF" positions. The controller 52 transmits control signals to the first clutch 58 to cause the clutch to disengage from the engine 30. The change in the statuses of the switches 100, 102 may be detected by the controller 52 at the block 136 and, combined with the disengagement of the rotor 24, the controller 52 may determine at the block 140 that the appropriate speed for the engine 30 is 1,000 RPM because the lights 84 are on but the rotor 24 is disengaged, and the engine 30 no longer requires the elevated low idle speed of 1,150 RPM.

The controller 52 may stop the conveyors 42, 44 during the delay period of the block 146 by transmitting control signals to the pump 60 to cease providing hydraulic fluid to the actuators of the conveyors 42, 44. The controller may also send control signals to the second clutch 62 to disengage from the engine 30 since no functions are being commanded that require the pump 60 to operate. If the operator turns the lights 84 off by setting the light switch 86 to the "OFF" position during the delay period, the controller 52 may turn off the lights 84 and send control of the engine speed control routine 130 back to the block 140 from the blocks 148, 150 where the controller 52 may determine that the engine speed should be further reduced to 800 RPM. Due to the further reduction, the controller 52 may wait an additional delay period at the block 146 before reducing the engine speed. During the further delay period, the operator may turn off the cold planer 10 and correspondingly stop the engine 30.

Those skilled in the art will understand that the preceding exemplary operation of the cold planer 10 and the engine 30 may have been controlled by the routine 170 with similar results based on the configuration of the machine function demand table 160 and engine speed lookup table 162. Moreover, the controller 52 and the routines 130, 170 may be configured to be modified as necessary after installation in the cold planer 10 to tune the performance of the routines 130, 170. The controller 52 and the machine display 110 may be configured to allow an operator or technician to input data for the tables 120, 160, 162 where the components are not performing as designed in the field. The machine display 110 may facilitate making adjustments to the idle engine speeds produced for various combinations of active functions and active functions totals (tables 120, 162), and to the engine power demand values for the machine functions (table 160). The controller 52 may also be configured to receive updates to the tables 120, 160, 162 from external devices. In various embodiments, the control console 50 may be provided with a connection port for an external device, such as parallel, serial or USB port, or the controller 52 may be operatively connected to an RF receiver, to facilitate downloading of the updates from the external device to the controller 52. Additional mechanisms for downloading data to the controller 52 for the tables 120, 160, 162 will be apparent to those skilled in the art, and are contemplated by the inventors as having use in cold planers 10 and other machinery in which the auto engine speed control routines 130, 170 may be implemented.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A cold planer comprising:

an engine;

a rotor configured to operatively engage and disengage from the engine;

a plurality of components including a plurality of legs, a plurality of sideplates, a moldboard, an anti-slab, a first stage conveyor, and a second stage conveyor each operatively connected to the engine to receive power from the engine to perform a corresponding function of the cold planer;

a plurality of control switches each corresponding to one of the functions performed by the plurality of components of the cold planer and configured to provide a control signal according to an actuation status for the corresponding function; and a controller operatively connected to the engine and the plurality of control switches, the controller configured to cause the engine to idle at a current idle engine speed corresponding to a current combination of active functions of the plurality of components based on the actuation statuses of the plurality of control switches when the engine is not engaged to propel the cold planer, the controller configured to determine a new combination of active functions of the plurality of components based on the actuation statuses of the plurality of control switches in response to an occurrence of a triggering event, the controller configured to compare the new combination of active functions to the current combination of active functions, and the controller configured to set the current idle engine speed equal to a new idle engine speed corresponding to the new combination of active functions of the plurality of components and to cause the engine to idle at the new idle engine speed in response to determining that the new combination of active functions is not equal to the current combination of active functions.

2. The cold planer of claim 1, wherein the controller is configured to store a current value of the actuation status for each of the plurality of control switches, wherein the controller is configured to determine that a new value of the actuation status in a control signal from at least one of the plurality of control switches is different from the current value of the actuation status of the one of the plurality of control switches stored at the controller, and wherein determining that the new value of the actuation status is different from the current value of the actuation status is the triggering event for determining the new combination of active functions.

3. The cold planer of claim 1, wherein configuring the controller to cause the engine to idle comprises:

the controller being configured to set a low idle engine speed equal to a rotor disengaged low idle engine speed in response to determining that the rotor is disengaged from the engine;

the controller being configured to set the low idle engine speed equal to a rotor engaged low idle engine speed in response to determining that the rotor is engaged by the engine; and the controller being configured to set the current idle engine speed equal to the low idle engine speed in response to determining that no functions are commanded by the actuation statuses of the plurality of control switches.

4. The cold planer of claim 3, wherein the controller is configured to compare an idle engine speed required for the engine to provide power to perform the new combination of active functions commanded by the actuation statuses of the plurality of control switches to the low idle engine speed, and wherein the controller is configured to set the new idle engine speed equal to the low idle engine speed in response to determining that the low idle engine speed is greater than the idle engine speed required for the engine to provide power to perform the new combination of active functions commanded by the actuation statuses of the plurality of control switches.

5. The cold planer of claim 1, wherein the controller is configured to store an engine speed lookup table having idle engine speeds required for providing power for combinations of active functions that can be commanded by the plurality of control switches, and wherein the controller is configured to determine the new idle engine speed from the engine speed lookup table based on the new combination of active functions commanded by the actuation statuses of the plurality of control switches.

6. The cold planer of claim 1, wherein configuring the controller to cause the engine to idle at the new idle engine speed comprises the controller being configured to cause the engine to idle at the new idle engine speed without waiting for a delay period in response to determining that the new idle engine speed is greater than the current idle engine speed.

7. The cold planer of claim 1, wherein configuring the controller to cause the engine to idle at the new idle engine speed comprises:

the controller being configured to initiate a delay period in response to determining that the new idle engine speed is less than the current idle engine speed;

the controller being configured to monitor the actuation statuses of the plurality of control switches; and the controller being configured to cause the engine to idle at the new idle engine speed after the expiration of the delay period in response to determining that the actuation statuses of the plurality of control switches did not change during the delay period.

8. The cold planer of claim 7, wherein the controller is configured to perform the determination of the new idle engine speed and comparison of the now idle engine speed to the current idle engine speed steps in response to determining that the actuation statuses of the plurality of control switches changed during the delay period.

9. The cold planer of claim 7, wherein the controller is configured to detect actuation of an engine speed control switch to a high idle status based on the actuation status of the engine speed control switch, to cause the engine to idle at a high idle engine speed in response to detecting the high idle status of the engine speed control switch, and to maintain the high idle engine speed as long as the engine speed control switch has the high idle status regardless of the combination of active functions of the plurality of components.

10. The cold planer of claim 1, wherein the triggering event for determining the new combination of active functions comprises the elapsing of a predetermined period of time.

11. The cold planer of claim 1, wherein the controller is configured to store a cold planer function demand table having an engine power demand value associated with each function performed by one of the plurality of components, and to store an engine speed lookup table having idle engine speeds required for providing power for combinations of active functions that can be commanded by the plurality of control switches, and wherein configuring the controller to compare the new combination of active functions to the current combination of active functions comprises:

the controller being configured to calculate a new active functions total by summing the engine power demand values from the cold planer function demand table for the active functions of the new combination of active functions, and the controller being configured to compare the new active functions total to a current active functions total, where the current active functions total is equal to the sum of the engine power demand values from the cold planer function demand table for the active functions of the current combination of active functions.

12. The cold planer of claim 11, wherein configuring the controller to cause the engine to idle at the new idle engine speed comprises the controller being configured to cause the engine to idle at the new idle engine speed without waiting for a delay period in response to determining that the new active functions total is greater than the current active functions total, and wherein the new idle engine speed is equal to an idle engine speed from the engine speed lookup table corresponding to the new active functions total.

13. The cold planer of claim 11, wherein configuring the controller to cause the engine to idle at the new idle engine speed comprises:

the controller being configured to initiate a first delay period in response to determining that the new active functions total is less than the current active functions total;

the controller being configured to determine a first delay active functions total after the expiration of the first delay period, wherein the first delay active functions total is equal to the sum of the engine power demand values from the cold planer function demand table for the active functions after the expiration of the first delay period; and the controller being configured to cause the engine to idle at the new idle engine speed without waiting for a second delay period in response to determining that the first delay active functions total is not less than the new active functions total.

14. The cold planer of claim 13, wherein configuring the controller to cause the engine to idle at the new idle engine speed comprises:

the controller being configured to initiate the second delay period in response to determining that the first delay active functions total is less than the new active functions total;

the controller being configured to determine a second delay active functions total after the expiration of the second delay period, wherein the second delay active functions total is equal to the sum of the engine power demand values from the cold planer function demand table or the active functions after the expiration of the second delay period; and the controller being configured to cause the engine to idle at the new idle engine speed without waiting for an additional delay period in response to determining that the second delay active functions total is not less than the first delay active functions total, wherein the new idle engine speed is equal to an idle engine speed from the engine speed lookup table corresponding to the second delay active functions total.

* * * * *